US007030070B2

(12) United States Patent
Sakurai et al.

(10) Patent No.: US 7,030,070 B2
(45) Date of Patent: Apr. 18, 2006

(54) COMPOSITION FOR HARD ARTICLE SURFACE CLEANING LIQUID

(75) Inventors: Kazutoshi Sakurai, Ohta-ku (JP); Hideaki Ohta, Ohta-ku (JP)

(73) Assignee: Takasago International Corporation, Tokyo (JP)

( * ) Notice: Subject to any disclaimer, the term of this patent is extended or adjusted under 35 U.S.C. 154(b) by 172 days.

(21) Appl. No.: 10/634,915

(22) Filed: Aug. 6, 2003

(65) Prior Publication Data

US 2004/0033912 A1 Feb. 19, 2004

(30) Foreign Application Priority Data

Aug. 13, 2002 (JP) ..... 2002-235537

(51) Int. Cl.
*C11D 3/50* (2006.01)

(52) U.S. Cl. ..... 510/106; 510/181; 510/235; 510/238; 510/239; 510/434

(58) Field of Classification Search ..... 510/434, 510/101, 179, 181, 235, 191, 238, 239, 106
See application file for complete search history.

(56) References Cited

U.S. PATENT DOCUMENTS 5,958,852 A * 9/1999 Yianakopoulos et al. ... 510/191
5,968,539 A * 10/1999 Beerse et al. ..... 424/405

FOREIGN PATENT DOCUMENTS

| | | | |
|---|---|---|---|
| EP | 0630962 | A2 | 12/1994 |
| JP | 53-94309 | | 8/1978 |
| JP | 55-147600 | A | 11/1980 |
| JP | 7-305100 | A | 11/1995 |
| JP | 7-116479 | A | 12/1995 |

* cited by examiner

*Primary Examiner*—John R. Hardee
(74) *Attorney, Agent, or Firm*—Sughrue Mion, PLLC

(57) ABSTRACT

A fragrant compound or fragrant composition stable for a long period of time in an acidic hard article surface cleaning liquid adjusted so as to be acidic, particularly to pH 2.0 to 3.0 with an organic acid. One or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, ethyl 2,2,6-trimethylcyclohexanecarboxylate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone are stable.

20 Claims, No Drawings

COMPOSITION FOR HARD ARTICLE SURFACE CLEANING LIQUID

FIELD OF THE INVENTION

The present invention relates to a fragrant composition for a hard article surface cleaning liquid and an acidic hard article surface cleaning liquid composition containing the fragrant composition, the cleaning liquid composition being adjusted so as to be acidic with an organic acid. Particularly, it relates to a fragrant composition for a hard article surface cleaning liquid and a hard article surface cleaning liquid composition adjusted to pH 2.0 to 3.0 with an organic acid.

BACKGROUND OF THE INVENTION

Heretofore, a large number of cleaning agents suitable for cleaning surface of hard articles such as bathroom tiles and toilet seats in a house have been developed and reported. Among these cleaning agents, in view of cleaning efficiency and safety in use, hard article surface cleaning agents acidified with an organic acid have been attracted much attention. As technologies on the cleaning agents, there are reported a combined use of an organic acid and sodium salt of an organic acid (JP-A-53-94309), a combined use of a hydroxy carboxylic acid and a surfactant (JP-A-55-147600), solidification of constituents of a hydroxy carboxylic acid etc. (JP-B-7-116479), and an acidic microemulsion containing a hydroxy carboxylic acid (JP-A-7-305100, EP 630963 A2). These technologies focuses on cleaning function how to remove stains and purposes to enhance cleaning power. Each of the publications contains a description of possible combined use of a fragrant material in the cleaning agent but no precise investigation has been made on the fragrant material to be used and detail of the fragrant material has not been described. JP-A-7-305100 only discloses that α-terpineol is suitable as the fragrant material but the compound is only described as suitable but is not investigated in detail, still less the other fragrant materials.

Recently, with regard to cleaning liquids, a product which has not only a high cleaning power but also is scented with fragrance pleasant to consumers has been required. In particular, for a product used in the house, it is strongly requested that a pleasant fragrance is maintained over a long period of time. However, the request cannot be satisfied even if a fragrant material be only added and mixed in the cleaning liquid for satisfying the request. The reason is mainly as follows. That is, many of fragrant materials are compounds having an ester group or an aldehyde group and in the case of a long-term storage of strongly acidic aqueous solution or dispersion of the fragrant materials, there is a possibility that the fragrant materials are hydrolyzed or oxidized during the storage. In particular, in the case of a long-term storage of strongly acidic aqueous solution or dispersion containing the fragrant compounds, there is a risk of deterioration of initial quality, e.g., change in appearance of the solution or dispersion, deterioration of the fragrance, or formation of precipitates.

An aqueous solution or dispersion adjusted so as to be strongly acidic with an organic acid can be widely utilized as a hard article surface cleaning agent but it is extremely important to provide a product scented with a pleasant fragrance in use. At selection of a fragrant material to be mixed, a fragrant compound or fragrant composition stable in an acidic hard article surface cleaning liquid adjusted so as to be strongly acidic, particularly to pH 2.0 to 3.0 is required.

SUMMARY OF THE INVENTION

Accordingly, it is an object to find out a fragrant compound or fragrant composition stable for a long period of time in an acidic hard article surface cleaning liquid adjusted so as to be acidic, particularly to pH 2.0 to 3.0 with an organic acid. Furthermore, it is also an object to provide a hard article surface cleaning liquid composition which contains the fragrant compound or fragrant composition and is adjusted so as to be strongly acidic with an organic acid.

As a result of extensive studies for solving the above problems, a fragrant composition for cleaning liquid for hard article surface, comprising one or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, ethyl 2,2,6-trimethylcyclohexanecarboxylate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone is a fragrant composition which exhibit no change in appearance and fragrant quality such as coloring and generation of precipitates in the hard article surface cleaning liquid adjusted so as to be acidic with an organic acid and further hardly occurs change in pH of the hard article surface cleaning liquid after a long-term storage as compared with the initial composition.

Namely, the invention provides:

(1) a hard article surface cleaning liquid composition, which comprises:

(a) a fragrant composition comprising one or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, ethyl 2,2,6-trimethylcyclohexanecarboxylate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid, and (c) a surfactant;

(2) the above hard article surface cleaning liquid composition, wherein the organic acid is oxalic acid and/or malonic acid;

(3) the above hard article surface cleaning liquid composition, wherein the organic acid is a hydroxy carboxylic acid;

(4) the above hard article surface cleaning liquid composition, wherein the hydroxy carboxylic acid is at least one hydroxy carboxylic acid selected from the group consisting of malic acid, citric acid, tartaric acid, lactic acid, and gluconic acid;

(5) a hard article surface cleaning liquid composition, which comprises:

(a) a fragrant composition comprising one or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, ethyl 2,2,6-trimethylcyclohexanecarboxylate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid, and (c) a surfactant, and wherein the pH of the hard article surface cleaning liquid composition is within the range of from 2.0 to 3.0;

(6) the above hard article surface cleaning liquid composition, wherein the organic acid is oxalic acid and/or malonic acid;

(7) the above hard article surface cleaning liquid composition, wherein the organic acid is a hydroxy carboxylic acid; and (8) the above hard article surface cleaning liquid composition, wherein the hydroxy carboxylic acid is at least one hydroxy carboxylic acid selected from the group consisting of malic acid, citric acid, tartaric acid, lactic acid, and gluconic acid.

DETAILED DESCRIPTION OF THE INVENTION

The following will describe the invention in further detail.

The fragrant compound for use in the invention includes 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, ethyl 2,2,6-trimethylcyclohexanecarboxylate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone. A fragrant composition for a hard article surface cleaning liquid is prepared by mixing one or more compounds of these fragrant compounds. Moreover, in addition to the fragrant compounds, natural fragrant materials and essential oils containing these compounds can be used as fragrant constituents of the invention within a range capable of achieving the aimed object. In this connection, the hard article means an article constituted by a substance itself having a hard nature, which is used for bathtub or inner wall in a bathroom, toilet sheets in a lavatory, and sink or inner wall in a kitchen.

The above fragrant compounds can be synthesized by known methods. In addition, the above fragrant compounds or the natural fragrant materials and essential oils containing the compounds may be purchased as commercially available products.

In the invention, one or more fragrant compounds of the invention are mixed in an amount of 10% by weight to 100% by weight based on the total amount of the fragrant composition.

To the fragrant composition of the invention may be added the other fragrant compound or an additives, as far as the aimed object can be achieved. The above other fragrant compound may include allyl 2-pentyloxyglycolate, p-ethyl-2,2-dimethylhydrocinnamaldehyde, α-fenchyl alcohol, β-damascone, cis-3-hexenyl benzoate, 3a,6,6,9a-tetramethyldodecahydronaphtho[2,1-b]furan, isobornyl cyclohexanol, ethyl hexahydro-4,7-methanoindene-3a-carboxylate, coumarin, cumin aldehyde, amyl salicylate, benzyl salicylate, cyclamen aldehyde, allyl cyclohexylpropionate, dihydroindenyl-2,4-dioxane, methyl dihydrojasmonate, dihydromyrcenol, diphenyl oxide, cinnamic alcohol, tetrahydro muguol, ethyl phenylacetate, hexamethylhexahydrocyclopentabenzopyran, hexyl alcohol, heptyl aldehyde, benzaldehyde, borneol, ethyl methylphenylglycidate, menthone, raspberry ketone, and undecyl aldehyde. Even when these fragrant compounds are added to and mixed with an acidic cleaning liquid and then the mixture is stored for a long period of time, no change is observed with time and also the fragrant quality changes only a little, so that they can be used as suitable fragrant compounds in the invention.

In the invention, a hard article surface cleaning liquid composition adjusted so as to be strongly acidic can be obtained by adding an organic acid to and mixing it with the above fragrant composition. At that time, although a more excellent cleaning effect is expectable at a lower pH value, it is preferable to adjust the composition so as to be acidic at about pH 2.0 to 3.0 in view of safety in consideration of its use in a house.

As an organic acid for use in the invention, oxalic acid and malonic acid are preferably used singly or as a mixture thereof. As the other organic acid, hydroxy carboxylic acids may be mentioned. Of these, at least one hydroxy carboxylic acid selected from the group consisting of malic acid, citric acid, tartaric acid, lactic acid, and gluconic acid is particularly preferred.

It is preferable to add further a surfactant as a solubilizing agent or emulsifying agent of the fragrant material to the above hard article surface cleaning liquid composition. As the above surfactant, there may be mentioned nonionic surfactants, for example. Representative examples thereof include alcohol ethers and aliphatic acid alkanol amides containing a polyoxyethylene (average added moles of oxyethylene group being from 1 to 20) group and alcohol ethers and aliphatic acid alcohol amides containing a polyoxyethylene-polyoxypropylene (sum of average added moles of oxyethylene group and average added moles of oxypropylene group being from 1 to 20) group. More specifically, examples thereof include polyoxyethylene(13) nonylphenyl ether, polyoxyethylene isostearyl ether, polyoxyethylene lauryl ether, polyoxyethylene oleylcetyl ether, polyoxyethylene stearyl ether, polyoxyethylene isocetyl ether, polyoxyethylene octyldodecyl ether, polyoxyethylene octylphenyl ether, polyoxyethylene polyoxypropylene stearyl ether, polyoxyethylene polyoxypropylene cetyl ether, polyoxyethylene polyoxypropylene decyltetradecyl ether, polyoxyethylene polyoxypropylene butyl ether, polyoxyethylene polyoxypropylene behenyl ether, polyoxyethylene polyoxypropylene lauryl ether, polyoxypropylene lanolin alcohol ether, polyoxypropylene lanolin(5.P.O), polyoxypropylene myristyl ether, polyoxypropylene butyl ether, polyoxypropylene stearyl ether, polyoxypropylene cetyl ether, polyoxypropylene gryceryl ether, polyoxyethylene palm oil fattyacid diethanolamide, and polyoxyethylene oleic acid diethanolamide.

In the invention, a thickening agent for adjusting the viscosity of the above composition and a coloring agent such as a dye or pigment for improving the appearance may be mixed. The above thickening agent includes polyacrylate salts, acrylic acid-maleic acid copolymers, and carboxymethyl cellulose derivatives. A small amount of an inorganic acid may be coexisted.

The hard article surface cleaning liquid composition thus prepared can be used as a final product of deodorant cleaning liquid even as it is but the other compounds which are mixed with a conventional hard article surface cleaning liquid may be further added and mixed. Examples thereof include amphoteric surfactant-based deodorants, plant extracts, nonionic surfactants, anionic surfactants, and dyes.

The fragrant composition for a hard article surface cleaning liquid of the invention can be mixed with a hard article surface cleaning liquid composition. The amount thereof to be mixed is not particularly limited but the fragrant composition is preferably mixed in an amount of 0.01% by weight to 3.0% by weight, particularly 0.1% by weight to 0.5% by weight based on the total composition of the hard article surface cleaning liquid, for example.

The surfactant may be used in an amount of 1 to 20 times the weight of the fragrant composition. The amount of the organic acid is not particularly limited as long as the pH of the hard article surface cleaning liquid composition can be adjusted within the range of from 2.0 to 3.0 and, for example, in an amount of 0.5 to 10% by weight based on the total composition of the hard article surface cleaning liquid composition.

The hard article surface cleaning liquid composition or the product of the hard article surface cleaning liquid of the invention can be used especially for cleaning surface of hard articles such as tiles and bathtub in a bathroom and toilet seats in a lavatory.

The following will describe the invention specifically with reference to Examples but the invention is by no means limited thereto.

EXAMPLE 1

A hard article surface cleaning liquid composition was produced by mixing constituents of the following formulation. The pH of the resulting composition was adjusted so as to be 2.0.

| Constituent | % by weight |
|---|---|
| Malic acid (99.5%) | 3.5 |
| Polyoxyethylene (13) nonylphenyl ether (Nonipol 130) | 3.0 |
| Fragrant material | 0.3 |
| Purified water | balance |
| Total | 100.0 |

The fragrant material in the above formulation is each compound described in Table 1 and Table 2.

EXAMPLE 2

Evaluation

In order to confirm the effect of the fragrant composition in the hard article surface cleaning liquid composition of the invention, the following evaluation was carried out. Specifically, sensory evaluation on appearance and fragrant quality of each composition was carried out by five panelists to judge the composition, and presence of pH change was determined by means of a pH meter.

A 30 g portion of each solution of the hard article surface cleaning liquid compositions containing various fragrant compounds produced in Example 1 was placed in each of two 50 ml glass vessel, followed by storage under a temperature of 50° C. or 5° C. (control). After passage of 2 weeks or 4 weeks, sensory evaluation on appearance and fragrant quality of each hard article surface cleaning liquid composition stored at 50° C. was carried out through comparison with the hard article surface cleaning liquid composition stored at 5° C. With regard to pH, a value after passage of 4 weeks at 5° C. or 50° C. was measured. In this connection, the pH of the cleaning liquid composition at the start of the experiment for evaluation was found to be 2.0. As a blank, using a hard article surface cleaning liquid composition produced without adding any fragrant material in the formulation of Example 1, sensory evaluation on appearance and fragrant quality was carried out and the pH value was measured as above. The results obtained are shown in Tables 1 and 2.

In this connection, it was confirmed that the hard article surface cleaning liquid composition containing a fragrant composition stored at 5° C. was stable both in appearance and fragrant quality. Also, it was confirmed that the hard article surface cleaning liquid composition with no incorporation of any fragrant material, as a blank, did not change in appearance and fragrant quality and the pH changed only a little even after passage of 4 weeks.

The sensory evaluation on appearance and fragrant quality was carried out according to the following five ranks.

5: No change was observed.

4: A slight change was observed.

3: A change was observed.

2: A considerable change was observed.

1: A drastic change was observed.

TABLE 1

| Name of fragrant compound | Sensory evaluation on appearance | | Sensory evaluation on fragrant quality | | pH after 4 weeks | |
|---|---|---|---|---|---|---|
| | After 2 weeks | After 4 weeks | After 2 weeks | After 4 weeks | 5° C. | 50° C. |
| 2,6-Dimethyl-2-heptanol | 5 | 5 | 5 | 5 | 1.94 | 1.94 |
| 3,3-Dimethylcyclo-hexyl methyl ketone | 5 | 5 | 5 | 5 | 1.94 | 1.94 |
| o-tert-Butylcyclo-hexanol | 5 | 5 | 5 | 5 | 1.96 | 1.96 |
| α-Amylcinnamic aldehyde | 5 | 5 | 5 | 5 | 1.94 | 1.94 |
| α-Damascone | 5 | 5 | 5 | 5 | 1.95 | 1.95 |
| γ-Octalactone | 5 | 5 | 5 | 5 | 1.96 | 1.96 |
| γ-Nonalactone | 5 | 5 | 5 | 5 | 1.96 | 1.96 |
| γ-Decalactone | 5 | 5 | 5 | 5 | 1.94 | 1.94 |
| Anethole | 5 | 5 | 5 | 5 | 1.94 | 1.94 |
| Ethyl benzoate | 5 | 5 | 5 | 5 | 1.95 | 1.95 |
| Ethyl 2,2,6-trimethylcyclo-hexane-carboxylate | 5 | 5 | 5 | 5 | 1.94 | 1.94 |
| 2,2,6-Trimethyl-1-crotonylcyclo-hexane | 5 | 5 | 5 | 5 | 1.94 | 1.94 |
| 6-acetyl-1,1,2,4,4,7-hexamethyl-tetrahydro-naphthalene | 5 | 5 | 5 | 5 | 1.94 | 1.94 |
| Isoamyl phenylethyl ether | 5 | 5 | 5 | 5 | 1.96 | 1.96 |
| Methyl octin carbonate | 5 | 5 | 5 | 5 | 1.96 | 1.96 |

TABLE 2

(continuation of Table 1)

| Name of fragrant compound | Sensory evaluation on appearance After 2 weeks | Sensory evaluation on appearance After 4 weeks | Sensory evaluation on fragrant quality After 2 weeks | Sensory evaluation on fragrant quality After 4 weeks | pH after 4 weeks 5° C. | pH after 4 weeks 50° C. |
|---|---|---|---|---|---|---|
| 6,7-Dihydro-1,1,2,3,3-pentamethyl-4(5H)-indanone | 5 | 5 | 5 | 5 | 1.94 | 1.94 |
| Tricyclodecenyl acetate | 5 | 5 | 5 | 5 | 1.95 | 1.95 |
| Undecyl aldehyde | 5 | 5 | 5 | 5 | 1.94 | 1.94 |
| Fenchyl acetate | 5 | 5 | 5 | 5 | 1.95 | 1.95 |
| Dihydrojasmone | 5 | 5 | 5 | 5 | 1.94 | 1.94 |
| Cedryl methyl ether | 5 | 5 | 5 | 5 | 1.95 | 1.95 |
| p-Cresol | 5 | 5 | 5 | 5 | 1.95 | 1.95 |
| Hexyl aldehyde | 5 | 5 | 5 | 5 | 1.94 | 1.94 |
| Rosephenone | 5 | 5 | 5 | 5 | 1.97 | 1.97 |

The compounds described in Tables 1 and 2 exhibited no change in appearance and fragrant quality, and also no change in pH was observed. Thus, the compounds were able to store in the hard article surface cleaning liquid composition at pH 2.0 for a long period of time.

COMPARATIVE EXAMPLE

Using each fragrant compound described in Table 3, a hard article surface cleaning liquid composition was produced. Further, sensory evaluation and pH measurement were carried out in a similar manner to the case in Example 2.

The results obtained are shown in Table 3.

TABLE 3

Comparative Example

| Name of fragrant compound | Sensory evaluation on appearance After 2 weeks | Sensory evaluation on appearance After 4 weeks | Sensory evaluation on fragrant quality After 2 weeks | Sensory evaluation on fragrant quality After 4 weeks | pH after 4 weeks 5° C. | pH after 4 weeks 50° C. |
|---|---|---|---|---|---|---|
| Linalool | 5 | 4 (yellowed) | 1.5 | 1 | 1.96 | 1.95 |
| Citronellol | 5 | 5 | 3 | 3 | 1.95 | 1.95 |
| Geraniol | 4 (yellowed) | 4 (yellowed) | 2 | 1 | 1.96 | 1.96 |
| Alloocimenol | 5 | 5 | 1 | 1 | 1.96 | 1.96 |
| Phenylethyl acetate | 5 | 4.5 | 2 | 1 | 1.96 | 1.96 |
| Terpineol | 5 | 4.5 | 1 | 1 | 1.95 | 1.95 |
| L-Menthol | 5 | 5 | 4 | 3 | 1.96 | 1.96 |
| Eucalyptus | 5 | 5 | 5 | 3 | 1.95 | 1.95 |
| Helional | 4 (yellowed | 3 (yellowish browned) | 4 | 4 | 1.94 | 1.94 |

When the fragrant compounds described in Table 3 were stored in the acidic hard article surface cleaning liquid composition, changes with time that appearance was yellowed or fragrant quality was changed were observed.

According to the invention, there can be provided a fragrant compound and a fragrant composition capable of storage for a long period of time without changing the initial fragrant quality and appearance even under a strongly acidic condition, especially even when mixed with an acidic hard article cleaning liquid of pH 2.0 to 3.0. Furthermore, a hard article surface cleaning liquid composition containing the fragrant compound or fragrant composition can be provided. The cleaning liquid composition is adjusted so as to be acidic with an organic acid and thus is excellent in safety and it also exhibits an excellent cleaning performance.

Furthermore, since the cleaning liquid product containing the fragrant compound or fragrant composition of the invention uses a stable fragrant material, the product exhibits no deterioration of the fragrant compound and thus can maintain a stable fragrance tone. Accordingly, the product is extremely useful.

While the invention has been described in detail and with reference to specific embodiments thereof, it will be apparent to one skilled in the art that various changes and modifications can be made therein without departing from the scope thereof.

This application is based on Japanese patent application No. 2002-235537 filed Aug. 13, 2002, the entire contents thereof being hereby incorporated by reference.

What is claimed is:

1. A hard article surface cleaning liquid composition, which comprises:

(a) a fragrant composition comprising ethyl-2,2,6-trimethylcyclohexanecarboxylate and optionally one or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid comprising malic acid, and (c) a surfactant.

2. The hard article surface cleaning liquid composition according to claim 1, which composition further comprises oxalic acid and/or malonic acid.

3. The hard article surface cleaning liquid composition according to claim 1, which composition further comprises a hydroxy carboxylic acid other than malic acid.

4. The hard article surface cleaning liquid composition according to claim 3, wherein the hydroxy carboxylic acid is at least one hydroxy carboxylic acid selected from the group consisting of citric acid, tartaric acid, lactic acid, and gluconic acid.

5. A hard article surface cleaning liquid composition according to claim 1, wherein the optionally one or more fragrant compounds are selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone.

6. A hard article surface cleaning liquid composition, which comprises:

(a) a fragrant composition comprising ethyl-2,2,6-trimethylcyclohexanecarboxylate and optionally one or more fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid comprising malic acid, and (c) a surfactant, and wherein the pH of the hard article surface cleaning liquid composition is within the range of from 2.0to 3.0.

7. The hard article surface cleaning liquid composition according to claim 6, which composition further comprises oxalic acid and/or malonic acid.

8. The hard article surface cleaning liquid composition according to claim 6, which composition further comprises a hydroxy carboxylic acid other than malic acid.

9. The hard article surface cleaning liquid composition according to claim 8, wherein the hydroxy carboxylic acid is at least one hydroxy carboxylic acid selected from the group consisting of citric acid, tartaric acid, lactic acid, and gluconic acid.

10. A hard article surface cleaning liquid composition according to claim 6, wherein the optionally one or more fragrant compounds are selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone.

11. A hard article surface cleaning liquid composition, which comprises:

(a) a fragrant composition comprising ethyl-2,2,6-trimethylcyclohexanecarboxylate and optionally one or more of fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-oetalactone, γ-nonalactone, γ-decalactone, anethole, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid, and (c) a surfactant.

12. The hard article surface cleaning liquid composition according to claim 11, wherein the organic acid is oxalic acid and/or malonic acid.

13. The hard article surface cleaning liquid composition according to claim 11, wherein the organic acid is a hydroxy carboxylic acid.

14. The hard article surface cleaning liquid composition according to claim 13, wherein the hydroxy carboxylic acid is at least one hydroxy carboxylic acid selected from the group consisting of malic acid citric acid, tartaric acid, lactic acid, and gluconic acid.

15. A hard article surface cleaning liquid composition according to claim 11, wherein the optionally one or more fragrant compounds are selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl. octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone.

16. A hard article surface cleaning liquid composition, which comprises:

(a) a fragrant composition comprising ethyl-2,2,6-trimethylcyclohexanecarboxylate and optionally one or more fragrant compounds selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, anethole, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone, (b) an organic acid, and (c) a surfactant, and wherein the pH of the hard article surface cleaning liquid composition is within the range of from 2.0to 3.0.

17. The hard article surface cleaning liquid composition according to claim 16, wherein the organic acid is oxalic acid and/or malonic acid.

18. The hard article surface cleaning liquid composition according to claim 16, wherein the organic acid is a hydroxy carboxylic acid.

19. The hard article surface cleaning liquid composition according to claim 18, wherein the hydroxy carboxylic acid is at least one hydroxy carboxylic acid selected from the group consisting of malic acid, citric acid, tartaric acid, lactic acid, and gluconic acid.

20. A hard article surface cleaning liquid composition according to claim 16, wherein the optionally one or more fragrant compounds are selected from the group consisting of 2,6-dimethyl-2-heptanol, 3,3-dimethylcyclohexyl methyl ketone, o-tert-butylcyclohexanol, α-amylcinnamic aldehyde, α-damascone, γ-octalactone, γ-nonalactone, γ-decalactone, ethyl benzoate, 2,2,6-trimethyl-1-crotonylcyclohexane, 6-acetyl-1,1,2,4,4,7-hexamethyltetrahydronaphthalene, isoamyl phenylethyl ether, methyl octin carbonate, 6,7-dihydro-1,1,2,3,3-pentamethyl-4(5H)-indanone, tricyclodecenyl acetate, undecyl aldehyde, fenchyl acetate, dihydrojasmone, cedryl methyl ether, p-cresol, hexyl aldehyde, and rosephenone.

* * * * *